US010587049B2

(12) United States Patent
Graff et al.

(10) Patent No.: US 10,587,049 B2
(45) Date of Patent: Mar. 10, 2020

(54) MAGNETIC ISOLATOR, METHOD OF MAKING THE SAME, AND DEVICE CONTAINING THE SAME

(71) Applicant: 3M INNOVATIVE PROPERTIES COMPANY, St. Paul, MN (US)

(72) Inventors: Michael S. Graff, Woodbury, MN (US); Seong-Woo Woo, Seoul (KR); Chuang Wei Chiu, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/780,403

(22) PCT Filed: Nov. 29, 2016

(86) PCT No.: PCT/US2016/063940
§ 371 (c)(1),
(2) Date: May 31, 2018

(87) PCT Pub. No.: WO2017/100029
PCT Pub. Date: Jun. 15, 2017

(65) Prior Publication Data

US 2018/0366834 A1 Dec. 20, 2018

Related U.S. Application Data

(60) Provisional application No. 62/264,381, filed on Dec. 8, 2015.

(51) Int. Cl.
*H01Q 17/00* (2006.01)
*H01F 1/153* (2006.01)
(Continued)

(52) U.S. Cl.
CPC ..... *H01Q 17/00* (2013.01); *H01F 1/15333* (2013.01); *H01F 1/24* (2013.01);
(Continued)

(58) Field of Classification Search
CPC ..... H01Q 1/22; H01Q 7/00; H01Q 17/00; H01Q 17/004
See application file for complete search history.

(56) References Cited

U.S. PATENT DOCUMENTS 6,456,466 B1 9/2002 Nakamoto
6,927,738 B2 8/2005 Senba
(Continued)

FOREIGN PATENT DOCUMENTS

CN 1855623 11/2006
EP 2797092 10/2014
(Continued)

OTHER PUBLICATIONS

FINEMET®, Nanocrystalline Fe-based Soft Magnetic Material with High Saturation Flux Density and Low Core Loss, Hitachi, Apr. 2005, pp. 1-12.
(Continued)

*Primary Examiner* — Hoang V Nguyen
(74) *Attorney, Agent, or Firm* — Robert S. Moshrefzadeh

(57) ABSTRACT

A magnetic isolator includes a dielectric film having a layer of electrically-conductive soft magnetic material bonded thereto. The layer of electrically-conductive soft magnetic material comprises substantially coplanar electrically-conductive soft magnetic islands separated one from another by a network of interconnected gaps. The interconnected gaps are at least partially filled with a thermoset dielectric material. The network of interconnected gaps at least partially suppresses electrical eddy current induced within the layer of soft magnetic material when in the presence of applied external magnetic field. An electronic device including the magnetic isolator and a method of making the magnetic isolator are also disclosed.

15 Claims, 4 Drawing Sheets

(51) Int. Cl.

| | |
|---|---|
| ***H01F 27/36*** | (2006.01) |
| ***H01F 1/24*** | (2006.01) |
| ***H01Q 1/38*** | (2006.01) |
| ***H01P 1/365*** | (2006.01) |
| ***H01Q 7/06*** | (2006.01) |
| *H01F 38/14* | (2006.01) |
| *H01Q 7/00* | (2006.01) |

(52) U.S. Cl.
CPC ..... *H01F 27/365* (2013.01); *H01P 1/365* (2013.01); *H01Q 1/38* (2013.01); *H01Q 7/06* (2013.01); *H01F 38/14* (2013.01); *H01Q 7/00* (2013.01)

(56) References Cited

U.S. PATENT DOCUMENTS

| | | | | |
|---|---|---|---|---|
| 7,667,655 | B2 | 2/2010 | Inoue | |
| 8,268,092 | B2 | 9/2012 | Yang | |
| 2003/0137763 | A1 | 7/2003 | Albrecht | |
| 2004/0066248 | A1* | 4/2004 | Komai ..... | H01P 1/387 333/24.2 |
| 2007/0171120 | A1 | 7/2007 | Puscasu et al. | |
| 2010/0294558 | A1 | 11/2010 | Mitsui | |
| 2011/0268950 | A1 | 11/2011 | Miyazawa | |
| 2012/0088070 | A1 | 4/2012 | Nishi | |
| 2012/0126911 | A1 | 5/2012 | Romanko | |
| 2014/0321010 | A1 | 10/2014 | Cho | |
| 2015/0102892 | A1 | 4/2015 | Yeo et al. | |
| 2015/0123604 | A1 | 5/2015 | Lee | |

FOREIGN PATENT DOCUMENTS

| | | | | |
|---|---|---|---|---|
| GB | 2314691 A | * | 1/1998 | ..... H01Q 15/246 |
| JP | 02044521 | | 2/1990 | |
| JP | 09081980 | | 3/1997 | |
| JP | 2005015293 | | 1/2005 | |
| JP | 2008112830 | | 5/2008 | |
| JP | 2009182062 | | 8/2009 | |
| JP | 4836749 | | 12/2011 | |
| KR | 20110138987 | | 12/2011 | |
| TW | 201429051 | | 7/2014 | |
| WO | WO 2013-104110 | | 7/2013 | |
| WO | WO 2014-088954 | | 6/2014 | |
| WO | WO 2017-099993 | | 6/2017 | |
| WO | WO 2017-100030 | | 6/2017 | |

OTHER PUBLICATIONS

Nakahara, "Electric insulation of a FeSiBC soft magnetic amorphous powder by a wet chemical method: Identification of the oxide layer and its thickness control", Acta Materialia, Oct. 2010, vol. 58, No. 17, pp. 5695-5703.

International Search Report for PCT International Application No. PCT/US2016/063940, dated Mar. 15, 2017, 3 pages.

* cited by examiner

MAGNETIC ISOLATOR, METHOD OF MAKING THE SAME, AND DEVICE CONTAINING THE SAME

TECHNICAL FIELD

The present disclosure broadly relates to magnetic isolators, methods of making the same, and devices containing them.

BACKGROUND

Near Field Communication (i.e., NFC) technology has recently become more popular for use in cellular phones in the background of the rapid growth of the Radio Frequency Identification (RFID) market. This technology opens up many new possibilities for cellular phones, for example, enabling the cellular phones to have the function of electronic keys, an ID card and an electronic wallet, and also enabling the exchange of phone numbers with other people to be done in a quick manner via wireless channels.

NFC is based on a 13.56 megahertz (MHz) RFID system which uses a magnetic field as carrier waves. However, the designed communication range may not be attained when a loop antenna is close to a metal case, shielded case, ground surface of a circuit board, or sheet surfaces such as a battery casing. This attenuation of carrier waves occurs because eddy current induced on the metal surface creates a magnetic field in the reverse direction to the carrier wave. Consequently, materials, such as Ni—Zn ferrites (with the formula: $Ni_aZn_{(1-a)}Fe_2O_4$), with high permeability that can shield the carrier wave from the metal surface are desired.

In typical NFC applications, an electronic device collects the magnetic flux circulating around a loop reader antenna. The flux that makes it through the device's coils excites a voltage around the coil path. When the antenna is placed over a conductor, there will be a dramatic reduction in magnetic field amplitudes close-in to the surface. For a perfect conductor, the tangential component of the electrical field is zero at any point of the surface. As a result, the presence of metal is generally detrimental to RFID tag coupling because there will be no normal component of the magnetic field at the conductor surface contributing to the total flux through the coil. According to Faraday's law, there will be no voltage excitation around the coil. Only marginal thickness of the dielectric substrate of the antenna allows small magnetic flux through the tag.

The detrimental effect of a metal surface near the antenna can be mitigated by putting a flux field directional material (i.e., a magnetic isolator) between the metal surface and the tag. An ideal high permeability magnetic isolator will concentrate the field in its thickness without making any difference in the normal magnetic field at its surface. Ferrite or other magnetic ceramics are traditionally used for this purpose because of their very low bulk conductivity. They show very little eddy current loss, and therefore a high proportion of magnetic field remains normal through the antenna loop. However, their relatively low permeability requires higher thickness of the isolator layer for efficient isolation, which increases cost and may be problematic in microminiaturized devices.

Nanocrystalline soft magnetic materials may supersede powdered ferrite and amorphous materials for high-frequency applications in electronics. In the last two decades, a new class of bulk metallic glasses with promising soft magnetic properties prepared by different casting techniques has been intensively investigated. Among the several developed metallic glass systems, Fe-based alloys have attracted considerable attention due to their good soft magnetic properties with near-to-zero magnetostriction, high saturation magnetization, and high permeability.

Among different Fe-based alloys, amorphous FeCuNbSiB alloys (e.g., those marketed by VACUUMSCHMELZE GmbH & Co. KG, Hanau, Germany, under the VITROPERM trade designation) are designed to transform into nanocrystalline material when annealed above 550° C. The resultant material shows much higher permeability than the as-spun amorphous ribbon. Due to the inherently conductive nature of the metallic ribbon, eddy current losses from the isolator can be problematic. In one approach to reducing eddy current loss, the annealed nanocrystalline ribbon has been placed on a carrier film and cracked into small pieces.

Eur. Pat. Appl. Publ. 2 797 092 A1 (Lee et al.) describes a magnetic field shield sheet for a wireless charger, which fills a gap between fine pieces of an amorphous ribbon through a flake treatment process of the amorphous ribbon and then a compression laminating process with an adhesive, to thereby prevent water penetration, and which simultaneously surrounds all surfaces of the fine pieces with an adhesive (or a dielectric) to thus mutually isolate the fine pieces to thereby promote reduction of eddy currents and prevent shielding performance from falling, and a manufacturing method thereof.

SUMMARY

However, flaked or cracked ribbons may have overlapping or contacting flakes resulting in continuous electrical paths in XY directions. Moreover malleable adhesives such as pressure-sensitive adhesives may deform over time resulting in contact points forming between the flakes, thereby increasing eddy current losses. It would be desirable to have materials whereby formation of such contact points (e.g., during handling) can be reduced or eliminated.

In one aspect, the present disclosure provides a magnetic isolator comprising a dielectric film having a layer of electrically-conductive soft magnetic material (i.e., ESMM) bonded thereto, wherein the layer of ESMM comprises substantially coplanar electrically-conductive soft magnetic islands separated one from another by a network of interconnected gaps, wherein the interconnected gaps are at least partially filled with a thermoset dielectric material, wherein the network of interconnected gaps at least partially suppresses electrical eddy current induced within the layer of soft magnetic material when in the presence of applied external magnetic field.

In another aspect the present disclosure provides a radio frequency identification tag adapted to wirelessly communicate with a remote transceiver, the radio frequency identification tag comprising:

an electrically-conductive substrate;

an antenna bonded to the substrate;

an integrated circuit disposed on the substrate and electrically coupled to the antenna; and a magnetic isolator according to the present disclosure, disposed between the antenna and the substrate.

In yet another aspect, the present disclosure provides a method of making a magnetic isolator, the method comprising steps:

a) providing a substrate having a continuous layer of ESMM bonded thereto;

b) forming a network of interconnected gaps in the layer of ESMM defining a plurality of electrically-conductive soft magnetic islands;

c) at least partially filling the network of interconnected gaps with a thermosetting dielectric material; and d) at least partially curing the thermosetting dielectric material, wherein the network of interconnected gaps at least partially suppresses eddy current induced within the layer of soft magnetic film by an external magnetic field.

As used herein, the term "permeability" refers magnetic permeability unless otherwise indicated.

As used herein, the term "thermoset" refers to a material that has been permanently hardened or solidified; e.g., by a curing process in which covalent chemical crosslinking occurs.

Features and advantages of the present disclosure will be further understood upon consideration of the detailed description as well as the appended claims.

Figure 1:
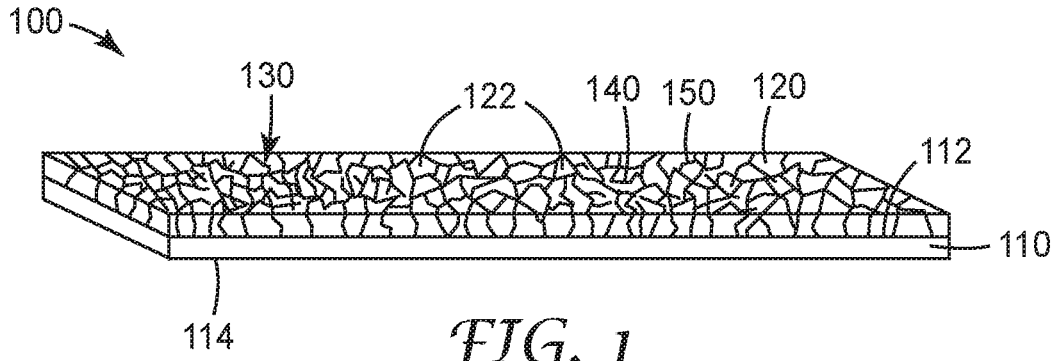
FIG. 1 is a schematic side view of exemplary magnetic isolator 100 according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Referring now to FIG. 1, magnetic isolator 100 according to the present disclosure comprise a dielectric film 110 having opposed major surfaces 112, 114. A layer of electrically-conductive soft magnetic material 120 (ESMM) is bonded to major surface 112. Layer 120 comprises a plurality of substantially coplanar electrically-conductive soft magnetic islands 122 separated one from another by a network 130 of interconnected gaps 140. Gaps 140 are at least partially filled with thermoset dielectric material 150. Network 130 of interconnected gaps 140 at least partially suppresses electrical eddy current (not shown) induced within the layer of soft magnetic material when in the presence of applied external magnetic field (not shown).

Any dielectric film may be used. Useful films include dielectric thermoplastic films comprising, for example, polyesters (e.g., polyethylene terephthalate and polycaprolactone), polyamides, polyimides, polyolefins, polycarbonates, polyetheretherketone (PEEK), polyetheretherimide, polyetherimide (PEI), cellulosics (e.g., cellulose acetate), and combinations thereof. The dielectric film may include one or more layers. For example, it may comprise a composite film made up of two or more dielectric polymer layers. In some embodiments, the dielectric film comprises a polymer film having a layer of pressure-sensitive adhesive that bonds the layer of ESMM to the polymer film.

The dielectric film may include high dielectric constant filler. Examples include barium titanate, strontium titanate, titanium dioxide, carbon black, and other known high dielectric constant materials. Nano-sized high dielectric constant particles and/or high dielectric constant conjugated polymers may also be used. Blends of two or more different high dielectric constant materials or blends of high dielectric constant materials and soft magnetic materials such as iron carbonyl may be used.

The dielectric film may have a thickness of about 0.01 millimeter (mm) to about 0.5 mm, preferably 0.01 mm to 0.3 mm, and more preferably 0.1 to 0.2 mm, although lesser and greater thicknesses may also be used.

Useful electrically-conductive soft magnetic materials include amorphous alloys, or amorphous alloys like FeCuNbSiB that transform into nanocrystalline material when annealed above 550° C. marketed by Vacuumschmelze GmbH & Co. KG, Hanau, Germany, under the VITROPERM trade designation), an iron/nickel material available under the trade designation PERMALLOY or its iron/nickel/molybdenum cousin MOLYPERMALLOY from Carpenter Technologies Corporation, Reading, Pa., and amorphous metal ribbons such as Metglass 2605SA1 by Hitachi Metals Inc.

Preferably, the ESMM comprises nanocrystalline ferrous material. In some embodiments, the ESMM may comprise an oxide of iron (Fe) which is doped by at least one metal element selected from the group including, but not limited to: Ni, Zn, Cu, Co, Ni, Nb, B, Si, Li, Mg, and Mn. One preferred soft magnetic material is formed by annealing amorphous soft magnetic ribbon precursor material available as VITROPERM VT-800 from Vacuumschmelze GmbH & Co. KG at a temperature of at least 550° C. to form a structure with nano-scale crystalline regions.

The layer of ESMM comprises islands of ESMM that are separated one from another by a network of interconnected gaps.

The islands of ESMM may have various regularly or irregular geometries such as, for example, plates and/or flakes, which may be micro- or nano-sized, although larger sizes may also be used. The ESMM may have a thickness of about 0.005 millimeter (mm) to about 0.5 mm, although lesser and greater thicknesses may also be used.

The permeability of the layer of electrically conductive soft magnetic material is largely determined by the materials of the layer and the areal density of the gaps and their depths. A layer of electrically conductive soft magnetic material having a permeability of larger than about 80 is preferable when used to make a magnetic isolator (e.g., an antenna isolator) capable of being used in NFC.

The real permeability represents how well a magnetic field travels, and the imaginary permeability represents a degree of loss of the magnetic field. An ideal material is a material exhibiting high permeability and having low permeability loss. In some embodiments, the real portion of the permeability of the magnetic isolator is not less than about 10 percent compared to a comparable magnetic isolator having a same construction except that it has no network of interconnected gaps. Likewise, in some embodiments, an imaginary portion of the permeability of the magnetic isolator is not more than about 90 percent of the imaginary portion of the permeability of a magnetic isolator having a same construction, except that it has no network of interconnected gaps.

Typically, the gaps are formed in a random or pseudo random network; however, the network may also be regular (e.g., an array). The array can be a rectangular array or a diamond array, for example. Preferably, the network of interconnected gaps is at least substantially coextensive with the layer of ESMM with respect to its length and width.

In some embodiments, the areal density of the gaps is from about 0.001 to about 60 percent, preferably about 0.01 to about 15 percent, and more preferably about 0.01 to about 6 percent. As used in the specification, the areal density of the gaps means a ratio of the area of all gaps in the layer of electrically conductive soft magnetic material to the overall area of the layer of electrically conductive soft magnetic material; the term "area" means the sectional area in a direction parallel to the top surface of the dielectric film.

Preferably, the depth of each of the gaps in the electrically-conductive soft magnetic layer is equal to the thickness of the layer itself (i.e., they extend through the layer to the dielectric film), although in some embodiments, some or all of the gaps may be shallower than the full thickness of the electrically-conductive soft magnetic layer. Accordingly, in some embodiments, a ratio of an average depth of the interconnected gaps to an average thickness of the electrically-conductive soft magnetic islands is at least 0.5, 0.6, 0.7, 0.8, or even at least 0.9.

The network of interconnected gaps at least partially suppresses electrical eddy current induced within the layer of ESMM by an external magnetic field. The magnitude of the effect depends on the composition and thickness of the layer of electrically-conductive magnetically soft material as well as the network of gaps.

The dielectric thermoset material is first of all dielectric. It may comprise any suitable cured resin system, optionally containing additives such as soft magnetic and non-magnetic dielectric fillers (e.g., as discussed hereinabove), curatives, colorants, antioxidants, etc. Examples of suitable thermoset materials include cured: vinyl ester resins, vinyl ether resins, epoxy resins, phenolic resins, urethane resins (either 1- or 2-part), polyurea resins, cyanate resins, alkyd resins, acrylic resins, aminoplast resins, urea-formaldehyde resins, and combinations thereof. The selection of materials, additives, and curative will typically depend on factors such as cost and processing parameters, and will be known to those of skill in the art.

Magnetic isolators according to the present disclosure can be made by laminating or otherwise bonding the layer of ESMM to the dielectric film; for example, using a pressure-sensitive adhesive, hot melt adhesive, or thermosetting adhesive (e.g., an uncured epoxy resin) followed by curing.

Magnetic isolators according to the present disclosure are typically used as sheets in the end use electronic articles, but may be desirably supplied in roll or sheet form; for example, for use in manufacturing equipment.

Once laminated, network of interconnected gaps in the layer of ESMM defining electrically-conductive soft magnetic islands is formed. Examples of suitable techniques for forming the network of gaps include mechanical gap forming techniques (e.g., by flexing, stretching, beating, and/or embossing) the layer of ESMM, ablation (laser ablation, an ultrasound ablation, an electrical ablation, and a thermal ablation), and chemical etching.

Preferably, the layer of ESMM and also the magnetic isolator is stretched during gap formation in length and/or width. This helps reduce accidental electrical contact between adjacent islands of the ESMM. Preferably, this stretching is at least 10 percent, at least 20 percent, or even at least 30 percent in at least one of the length or width of the magnetic isolator.

Once the gaps are formed, they are filled (at least partially) with thermosetting material that then can be cured to form the thermoset. Curing may be effected by heating and/or electromagnetic radiation, for example, and is within the capabilities of those having ordinary skill in the art.

Magnetic isolators according to the present disclosure are useful for extending the read range of NFC electronic devices.

Figure 2:
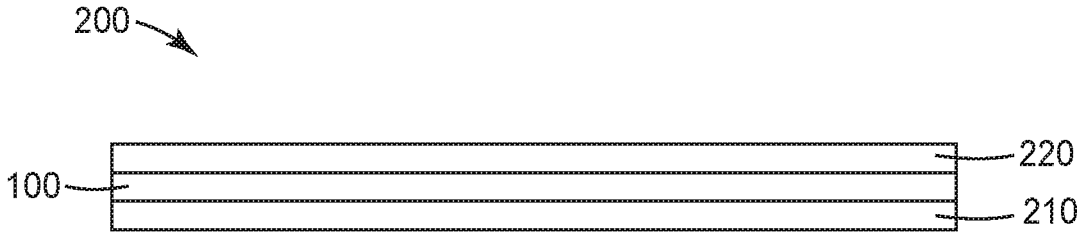
FIG. 2 is a schematic side view of exemplary electronic article 200 according to the present disclosure.

Referring now to FIG. 2, exemplary electronic article 200 capable of near field communication with a remote transceiver includes substrate 210 and antenna 220. Magnetic isolator 100 (see FIG. 1) according to the present disclosure is disposed between antenna 220 and substrate 210. For maximum benefit substrate 210 is electrically conductive (e.g., comprising metal and/or other conducting material).

Antenna 220 (e.g., a conductive loop antenna) can be a copper or aluminum etched antenna, for example, and may be disposed on a dielectric polymer (e.g., PET polyester) film substrate. Its shape can be, for example, a ring shape, a rectangular shape or a square shape with the resonant frequency of 13.56 MHz. The size can be from about 80 $cm^2$ to about 0.1 $cm^2$ with a thickness of about 35 microns to about 10 microns, for example. Preferably, the real component of the impedance of the conductive loop antenna is below about 5Ω.

Integrated circuit 240 is disposed on substrate 210 and electrically coupled to loop antenna 220.

Exemplary electronic devices include cell phones, tablets, and other devices equipped with near field communication, devices equipped with wireless power charging, devices equipped with magnetic shielding materials to prevent interference from conductive metal objects within the device or in the surrounding environment.

Select Embodiments of the Present Disclosure

In a first embodiment, the present disclosure provides a magnetic isolator comprising a dielectric film having a layer of electrically-conductive soft magnetic material bonded thereto, wherein the layer of electrically-conductive soft magnetic material comprises substantially coplanar electrically-conductive soft magnetic islands separated one from another by a network of interconnected gaps, wherein the interconnected gaps are at least partially filled with a thermoset dielectric material, wherein the network of interconnected gaps at least partially suppresses electrical eddy current induced within the layer of soft magnetic material when in the presence of applied external magnetic field.

In a second embodiment, the present disclosure provides a magnetic isolator according to the first embodiment, wherein the thermoset dielectric material comprises a cured epoxy resin.

In a third embodiment, the present disclosure provides a magnetic isolator according to the first or second embodiment, wherein a majority of the electrically-conductive soft magnetic islands are independently electrically isolated from all adjacent ones of the electrically-conductive soft magnetic islands.

In a fourth embodiment, the present disclosure provides a magnetic isolator according to any one of the first to third embodiments, wherein the network of interconnected gaps is coextensive with the layer of electrically-conductive soft magnetic material along its length and width.

In a fifth embodiment, the present disclosure provides a magnetic isolator according to any one of the first to fourth embodiments, wherein a real portion of the permeability of the magnetic isolator is not less than about 10 percent compared to a comparable magnetic isolator having a same construction except that it has no network of interconnected gaps.

In a sixth embodiment, the present disclosure provides a magnetic isolator according to any one of the first to fifth embodiments, wherein an imaginary portion of the permeability of the magnetic isolator is not more than about 90 percent of the imaginary portion of the permeability of a magnetic isolator having a same construction, except that it has no network of interconnected gaps.

In a seventh embodiment, the present disclosure provides an electronic device adapted to inductively couple with a remotely generated magnetic field, the electronic device comprising:

a substrate;

an antenna bonded to the substrate;

an integrated circuit disposed on the substrate and electrically coupled to the antenna; and a magnetic isolator according to any one of the first to sixth embodiments, disposed between the antenna and the substrate.

In an eighth embodiment, the present disclosure provides an electronic device according to the seventh embodiment, wherein the antenna comprises a loop antenna.

In a ninth embodiment, the present disclosure provides a method of making a magnetic isolator, the method comprising steps:

a) providing a substrate having a continuous layer of an electrically-conductive soft magnetic material bonded thereto;

b) forming a network of interconnected gaps in the layer of electrically-conductive soft magnetic material defining a plurality of electrically-conductive soft magnetic islands;

c) at least partially filling the network of interconnected gaps with a dielectric thermosetting material; and d) at least partially curing the curable dielectric material, wherein the network of interconnected gaps at least partially suppresses eddy current induced within the layer of soft magnetic film by an external magnetic field.

In a tenth embodiment, the present disclosure provides a method according to the ninth embodiment, wherein the electrically-conductive soft magnetic islands comprise nanocrystalline ferrous material.

In an eleventh embodiment, the present disclosure provides a method according to the ninth or tenth embodiment, wherein the curable resin is selected from the group consisting of epoxy resins, polyurethane resins, polyurea resins, cyanate resins, alkyd resins, acrylic resins, aminoplast resins, phenolic resins, urea-formaldehyde resins.

In a twelfth embodiment, the present disclosure provides a method according to any one of the ninth to eleventh embodiments, wherein the network of interconnected gaps is coextensive with the layer of electrically-conductive soft magnetic material along its length and width.

In a thirteenth embodiment, the present disclosure provides a method according to any one of the ninth to twelfth embodiments, wherein in step b), the network of interconnected gaps is provided at least partially by intentionally mechanically cracking the continuous layer of an electrically-conductive soft magnetic material.

In a fourteenth embodiment, the present disclosure provides a method according to any one of the ninth to thirteenth embodiments, wherein the network of interconnected gaps is provided at least partially by ablation of the continuous layer of an electrically-conductive soft magnetic material.

In a fifteenth embodiment, the present disclosure provides a method according to any one of the ninth to fourteenth embodiments, wherein the ablation comprises one or more of a laser ablation, an ultrasound ablation, an electrical ablation, and a thermal ablation.

In a sixteenth embodiment, the present disclosure provides a method according to any one of the ninth to fifteenth embodiments, wherein step and b) comprises stretching the substrate by at least 5 percent in at least one dimension.

In a seventeenth embodiment, the present disclosure provides a method according to any one of the ninth to sixteenth embodiments, wherein step and b) comprises stretching the substrate by at least 10 percent in at least one dimension.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

TABLE OF MATERIALS

Figure 3:
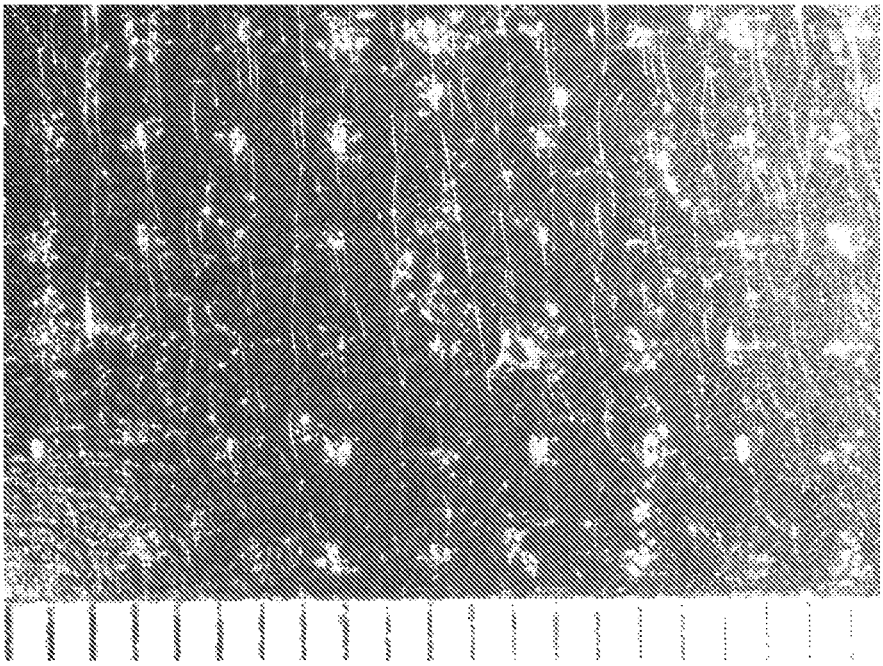
FIG. 3 is a photomicrograph of EM07HM used in the examples.
Figure 4:
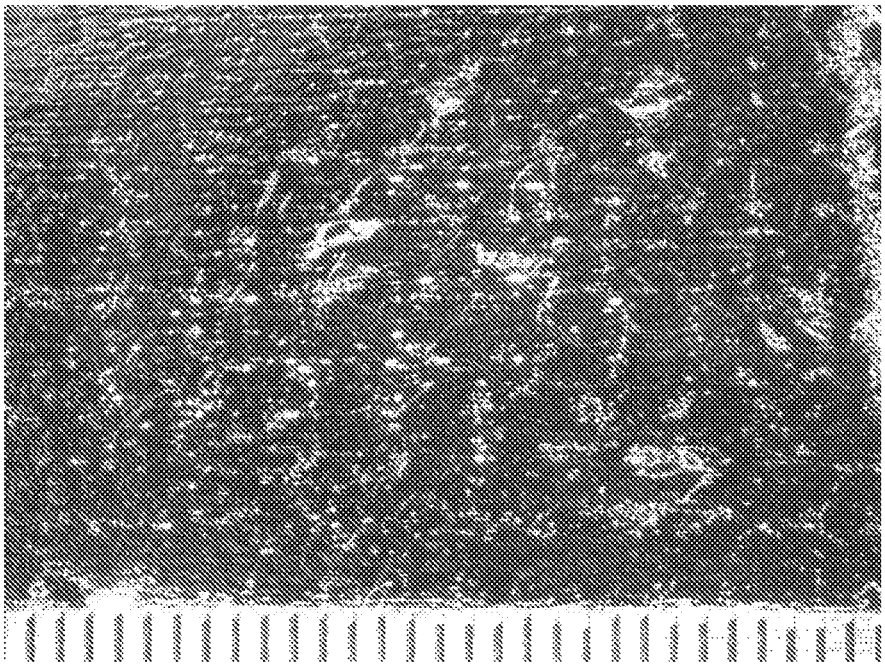
FIG. 4 is a photomicrograph of EM05KM used in the examples.

| ABBREVIATION | DESCRIPTION |
|---|---|
| EM09KM | ferromagnetic electrically conductive ribbon prepared by annealing amorphous magnetic ribbon precursor material VITROPERM 800 from Vacuumschmelze, Germany) at 500° C. to 550° C. according to the manufacturer's directions, not cracked. |
| EM05KM | ferromagnetic electrically conductive ribbon prepared by annealing amorphous magnetic ribbon precursor material VITROPERM 800 from Vacuumschmelze, Germany) at 500° C. to 550° C. according to the manufacturer's directions, coarse cracked, shown in FIG. 3. |
| EM07HM | ferromagnetic electrically conductive ribbon prepared by annealing amorphous magnetic ribbon precursor material VITROPERM 800 from Vacuumschmelze, Germany) at 500° C. to 550° C. according to the manufacturer's directions, fine cracked, shown in FIG. 4. |
| EP1 | 3M SCOTCHCAST TWO-PART ELECTRICAL RESIN two-part epoxy resin, available from 3M Company, St. Paul, Minnesota |

Example 1

A rubber sheet was lightly adhered to one side of the MEM07HM electrically-conductive soft-magnetic nanocrystalline ribbon.

Figure 5:
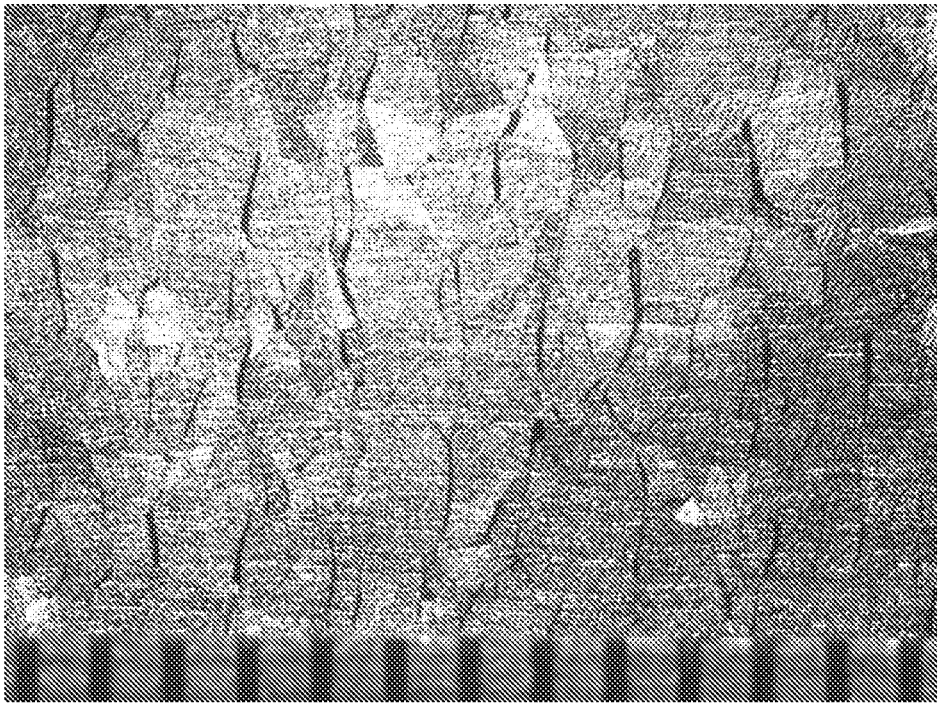
FIG. 5 is a photomicrograph of EM05KM after flexing and filling with epoxy resin and curing according to Example 1.

In this format the ribbon was lightly adhered to a rubber sheet, which served as a flexible support. The two-part epoxy resin was mixed and applied to the ribbon surface. The rubber sheet with attached specified nanocrystalline ribbon material was flexed in down-web and cross-web directions to separate broken fragments and allow the liquid resin to wet and fill the gaps therebetween to provide a thin layer of electrical insulation between the fragments. At the end of this process, the nanocrystalline ribbon formed a layer of substantially coplanar electrically-conductive soft magnetic islands that were disposed on the rubber sheet and were separated one from another by a network of interconnected gaps Excess epoxy resin was removed from the exposed flat surface, and allowed to cure according to the manufacturer's directions. FIG. 5 shows a sample of the EM07HM ribbon after flexing while filling with epoxy, and then curing as above (EXAMPLE 1). The resultant magnetic isolator was characterized by a layer of electrically conductive soft magnetic material with a fine interconnected network of interconnected gaps, filled with cured epoxy resin, and adhered to a rubber sheet.

Figure 6:
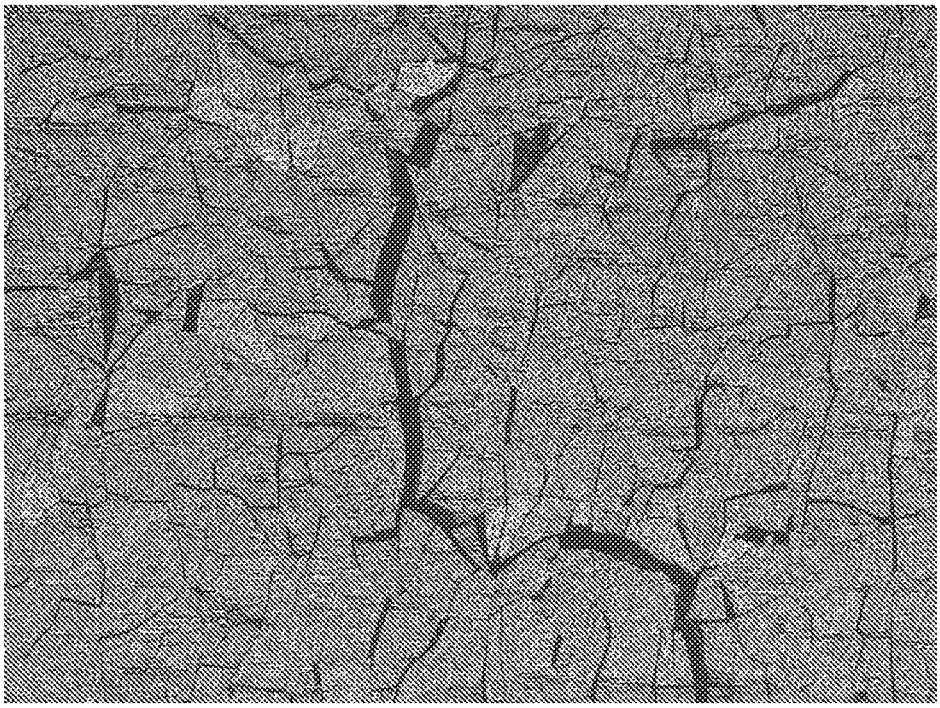
FIG. 6 is a photomicrograph of EM05KM after stretching.

For comparison, a piece of the EM07HM ribbon that had been stretched but not filled with epoxy is shown in FIG. 6.

Effect of Epoxy-Filled Gaps on NFC Read Distance

Figure 7:
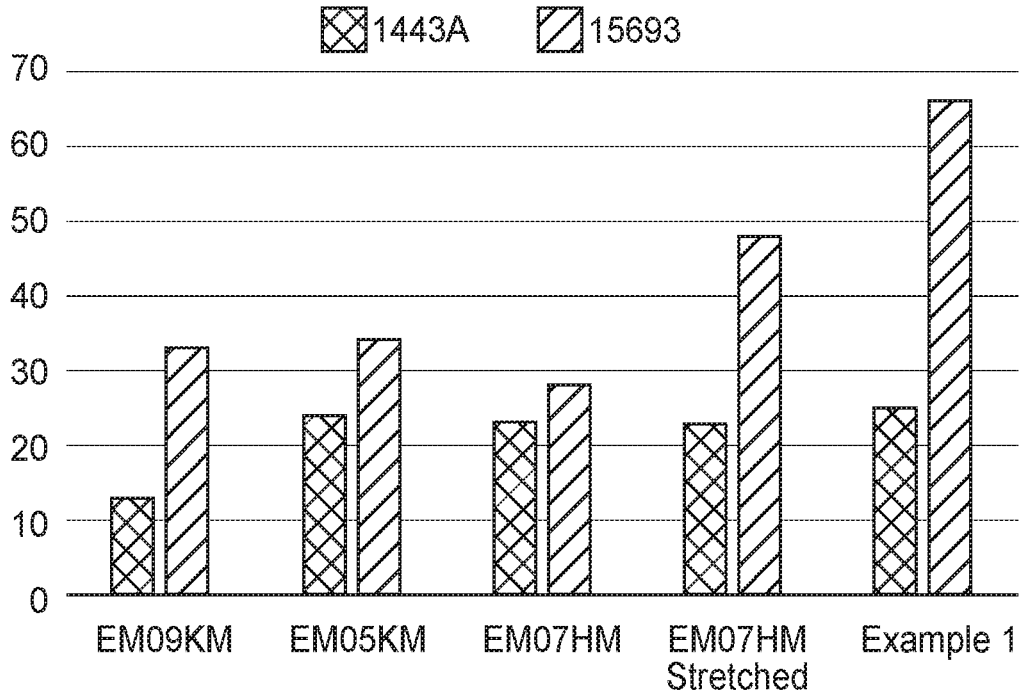
FIG. 7 is a bar graph reporting read distances for various specimens including the magnetic isolator of Example 1.

A critical performance characteristic in near field communications (NFC) is the maximum read distance between a powered antenna, shielded from a metal plate with an isolator, and a passive responder antenna as shown in FIG. 7. In the following procedure, read distance measurements were made using an NFC reader kit obtained from 3A Logics NFC that was configured to be able to conform to both ISO/IEC 14443A and ISO 15693 digital signal processing protocols.

The ISO/IEC 14443A digital signal processing protocol features a higher data transmission rate over a shorter read distance. This protocol shows the most pronounced benefit from the first stage of cracking. On the other hand, the ISO 15693 protocol features a lower data transmission rate over a longer read distance. This protocol showed more of a benefit from filling the network of interconnected gaps with cured epoxy resin.

Samples of materials were evaluated according to ISO/IEC 14443A and ISO 15693 digital signal processing protocols. Results reported in FIG. 7 represent maximum NFC read distances between a powered antenna, shielded from a metal plate with an isolator, and a passive reader antenna evaluated according to each method.

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A magnetic isolator comprising a dielectric film having a layer of electrically-conductive soft magnetic material bonded thereto, wherein the layer of electrically-conductive soft magnetic material comprises substantially coplanar electrically-conductive soft magnetic islands separated one from another by a network of interconnected gaps, wherein the interconnected gaps are at least partially filled with a thermoset dielectric material, wherein the network of interconnected gaps at least partially suppresses electrical eddy current induced within the layer of soft magnetic material when in the presence of applied external magnetic field.

2. The magnetic isolator of claim 1, wherein the thermoset dielectric material comprises a cured epoxy resin.

3. The magnetic isolator of claim 1, wherein a majority of the electrically-conductive soft magnetic islands are independently electrically isolated from all adjacent ones of the electrically-conductive soft magnetic islands.

4. The magnetic isolator of claim 1, wherein the network of interconnected gaps is coextensive with the layer of electrically-conductive soft magnetic material along its length and width.

5. An electronic device adapted to inductively couple with a remotely generated magnetic field, the electronic device comprising:

a substrate;

an antenna bonded to the substrate;

an integrated circuit disposed on the substrate and electrically coupled to the antenna; and a magnetic isolator according to claim 1 disposed between the antenna and the substrate.

6. The electronic device of claim 5, wherein the antenna comprises a loop antenna.

7. A method of making a magnetic isolator, the method comprising steps:

a) providing a substrate having a continuous layer of an electrically-conductive soft magnetic material bonded thereto;

b) forming a network of interconnected gaps in the layer of electrically-conductive soft magnetic material defining a plurality of electrically-conductive soft magnetic islands;

c) at least partially filling the network of interconnected gaps with a dielectric thermosetting material; and d) at least partially curing the dielectric thermosetting material, wherein the network of interconnected gaps at least partially suppresses eddy current induced within the layer of soft magnetic film by an external magnetic field.

8. The method of claim 7, wherein the electrically-conductive soft magnetic islands comprise nanocrystalline ferrous material.

9. The method of claim 7, wherein the dielectric thermosetting material is selected from the group consisting of epoxy resins, polyurethane resins, polyurea resins, cyanate resins, alkyd resins, acrylic resins, aminoplast resins, phenolic resins, urea-formaldehyde resins.

10. The method of claim 7, wherein the network of interconnected gaps is coextensive with the layer of electrically-conductive soft magnetic material along its length and width.

11. The method of claim 7, wherein in step b), the network of interconnected gaps is provided at least partially by intentionally mechanically cracking the continuous layer of an electrically-conductive soft magnetic material.

12. The method of claim 7, wherein the network of interconnected gaps is provided at least partially by ablation of the continuous layer of an electrically-conductive soft magnetic material.

13. The method of claim 12, wherein the ablation comprises one or more of a laser ablation, an ultrasound ablation, an electrical ablation, and a thermal ablation.

14. The method of claim 7, wherein step b) comprises stretching the substrate by at least 5 percent in at least one dimension.

15. The method of claim 7, wherein step b) comprises stretching the substrate by at least 10 percent in at least one dimension.

* * * * *